US008220157B2

(12) United States Patent
Shimizu

(10) Patent No.: US 8,220,157 B2
(45) Date of Patent: Jul. 17, 2012

(54) ROTARY ELECTRIC SHAVER

(75) Inventor: Tetsuhiko Shimizu, Matsumoto (JP)

(73) Assignee: Izumi Products Company, Matsumoto, Nagano (JP)

( * ) Notice: Subject to any disclaimer, the term of this patent is extended or adjusted under 35 U.S.C. 154(b) by 413 days.

(21) Appl. No.: 12/490,733

(22) Filed: Jun. 24, 2009

(65) Prior Publication Data

US 2009/0320295 A1 Dec. 31, 2009

(30) Foreign Application Priority Data

Jun. 27, 2008 (JP) ..... 2008-168805

(51) Int. Cl.
*B26B 19/04* (2006.01)
*B26B 19/14* (2006.01)

(52) U.S. Cl. ..... 30/43.4; 30/43.5; 30/43.6

(58) Field of Classification Search ..... 30/43.4–43.6
See application file for complete search history.

(56) References Cited

U.S. PATENT DOCUMENTS

| | | | | |
|---|---|---|---|---|
| 3,913,225 | A * | 10/1975 | Tietjens et al. | 30/43.6 |
| 5,625,950 | A * | 5/1997 | Sterk et al. | 30/43.6 |
| 6,568,081 | B2 * | 5/2003 | Barish | 30/43.6 |
| 6,647,626 | B2 * | 11/2003 | Nakano | 30/43.4 |
| 6,823,590 | B2 * | 11/2004 | Uchiyama et al. | 30/43.6 |
| 6,868,611 | B2 * | 3/2005 | Geertsma et al. | 30/43.6 |
| 7,152,324 | B2 * | 12/2006 | Uchiyama | 30/43.6 |
| 7,222,428 | B2 * | 5/2007 | Koike | 30/43.5 |
| 7,269,902 | B2 * | 9/2007 | Van Der Meer | 30/43.6 |
| 7,370,420 | B2 * | 5/2008 | Shimizu | 30/43.4 |
| 7,401,407 | B2 * | 7/2008 | Miyasaka | 30/43.6 |
| 7,487,592 | B2 * | 2/2009 | Koike | 30/43.4 |
| 7,584,541 | B2 * | 9/2009 | Uchiyama | 30/43.4 |
| 7,603,777 | B2 * | 10/2009 | Shumizu | 30/43.6 |
| 7,743,508 | B2 * | 6/2010 | Shimizu | 30/43.6 |
| 7,845,078 | B2 * | 12/2010 | Shimizu | 30/43.5 |
| 2007/0124936 | A1 * | 6/2007 | Okabe | 30/43.6 |
| 2008/0092393 | A1 * | 4/2008 | Van Der Meer | 30/43.6 |
| 2009/0320294 | A1 * | 12/2009 | Shimizu | 30/43.6 |
| 2010/0011589 | A1 * | 1/2010 | Van Der Borst et al. | 30/43.4 |
| 2010/0018058 | A1 * | 1/2010 | Brada et al. | 30/43.6 |
| 2010/0058594 | A1 * | 3/2010 | Westerhof et al. | 30/43.4 |
| 2011/0030220 | A1 * | 2/2011 | Shimizu | 30/43.6 |

(Continued)

FOREIGN PATENT DOCUMENTS

EP 1 785 239 A1 5/2007

(Continued)

OTHER PUBLICATIONS

Sky Mall ®, Summer 2007, Norelco arcitec Electric Shaver, p. 110.*

(Continued)

*Primary Examiner* — Jason Daniel Prone
(74) *Attorney, Agent, or Firm* — Sughrue Mion, PLLC

(57) ABSTRACT

The rotary electric shaver comprising; cutter circumferential rims (24), each of which is separately provided for each outer cutter (16) and which holds the outer cutter by surrounding the outer periphery of the outer cutter, and pivotal supporting sections (22) which pivotably and removably hold the cutter circumferential rim on a pivotal axis (C) passing the center (Q) of the outer cutter. The upper surface of the cutter circumferential rim is extended out over the pivotal supporting sections, thus increasing the width of the upper surface of the cutter circumferential rim.

9 Claims, 8 Drawing Sheets

U.S. PATENT DOCUMENTS

2011/0308088 A1* 12/2011 Brada et al. ..... 30/43.6

FOREIGN PATENT DOCUMENTS

| | | | | |
|---|---|---|---|---|
| EP | 1 854 592 | A1 | | 11/2007 |
| EP | 1 862 271 | A1 | | 12/2007 |
| EP | 2138283 | A1 | * | 12/2009 |
| EP | 2138284 | A1 | * | 12/2009 |
| JP | 09-503424 | | | 4/1997 |
| JP | 2007-151925 | A | | 6/2007 |
| JP | 2010005189 | A | * | 1/2010 |
| JP | 2010005190 | A | * | 1/2010 |
| JP | 2011030982 | A | * | 2/2011 |
| JP | 2011098041 | A | * | 5/2011 |
| WO | 2006/056950 | A1 | | 6/2006 |
| WO | 2006/067710 | A1 | | 6/2006 |

OTHER PUBLICATIONS

EP Communication, dated Oct. 5, 2009, issued in corresponding EP Application No. 09163893.2, 4 pages.

* cited by examiner

ROTARY ELECTRIC SHAVER

BACKGROUND OF THE INVENTION

1. Field of the Invention

The present invention relates to a rotary electric shaver which rotatively drives inner cutters, which are in resilient contact with inner bottom surfaces of circular outer cutters.

2. Description of the Related Art

There has been known a so-called rotary electric shaver which has circular or disk-shaped outer cutters and inner cutter rotating on the inner side of the outer cutters so that beard hair entering the hair introduction slits formed in the outer cutters is cut by the rotating inner cutters. As this type of electric shaver, there has been known in which outer cutter installing holes are formed in an outer cutter frame secured to a shaver main body and circular outer cutters are supported in the outer cutter installing holes such that the outer cutters are slightly movable in a vertical direction and slightly inclinable with respect to the outer cutter frame.

However, the aforesaid construction provides the outer cutters with a limited movable range relative to the outer cutter frame, thus presenting a problem in that the close contact between the outer cutters and skin is restricted with resultant unsatisfactory shaving feeling or inadequate user-friendliness. It has been proposed, therefore, to provide a rim which is movable relative to the main body (the rim being also referred to as an outer cutter rim, an cutter circumferential rim, a skin supporting rim or a skin protecting rim) between the outer cutters and the main body (the outer cutter frame) so as to expand the movable range and the inclinable range of the outer cutters.

JP 9-503424(T) (corresponding to WO 96/02368, U.S. Pat. No. 5,625,950 and EP 0719203) discloses a shaving apparatus which has a skin supporting rim (6) provided between an outer cutter and a main body (an outer cutter frame and a holder 2). The outer cutter is held by the rim such that it is slightly movable in a vertical direction and also slightly inclinable, and the outer periphery of the rim is pivotally supported by the outer cutter frame of the main body. More specifically, the rim enters a circular opening of the outer cutter frame, and a pair of projections provided on the outer periphery of the rim is engaged with the inner peripheral surface of the opening provided in the outer cutter frame. In other words, a pivotal supporting section is disposed between the outer periphery of the rim and the opening of the outer cutter frame.

JP 2007-151925(A) (corresponding to US 2007-124936 (A1)) discloses a shaving apparatus in which the outer periphery of a rim (a cutting member frame 18) is pivotably supported on the inner side (adjacent to the center of the outer cutter) of an upright wall (a supporting section 54) provided on a main body.

Both shaving apparatuses disclosed in the documents of the prior arts each has a pivotal supporting section provided between the rim and a fixed unit (the outer cutter frame or the upright wall) of the main body surrounding the rim, thus presenting a problem in that the width of the rim in the radial direction is limited or the outer cutter frame of the main body surrounding the rim inevitably becomes large. In particular, a small width of the rim in the radial direction causes the outer cutter to strongly abut against the skin when the outer cutter is pressed against the skin, thereby a consequent high contact pressure is applied by the outer cutter. At this time, the outer cutter slightly moves down relative to the rim, however, the movable amount thereof is limited, leading to a high pressure of contact between the outer cutter and the skin. This may give rise to a problem of easily hurting the skin.

Further, the pivotal supporting section is exposed between the outer periphery of the rim and the main body (the outer cutter frame or the upright wall), so that shaving debris easily adhere to the pivotal supporting section. This may lead to unsmooth operation of the pivotal supporting section and may prevent the rim from effecting pivotable movement, resulting in poor shaving feeling. In addition, there has been a problem in that shaving debris are not easily removed.

SUMMARY OF THE INVENTION

The present invention has been accomplished under the circumstances as aforementioned, and an object thereof is to provide a rotary electric shaver which reduces the contact pressure applied by an outer cutter and a rim surrounding the outer cutter (hereinafter referred to also as "the cutter circumferential rim" or "outer cutter rim") to skin thereby to adequately protect the skin, permits a reduced size of a head unit at the top of a main body, minimizes the chances of shaving debris adhering to a pivotal supporting section, allows the cutter circumferential rim to effect smooth pivotable movement for a prolonged time, and permits easy removal of shaving debris.

According to the present invention, the aforesaid object is achieved by a rotary electric shaver which pivotably holds a plurality of outer cutters on a head bottom plate disposed at the top of a shaver main body and rotatively drives inner cutters while bringing the inner cutters into resilient contact with inner surfaces of the outer cutters, the rotary electric shaver comprising:

a plurality of cutter circumferential rims, each of which is separately provided for each outer cutter and surrounds and holds the outer periphery of the outer cutter; and a pivotal supporting section which pivotably and detachably retains the respective cutter circumferential rims on a pivotal axis passing the center of the respective outer cutter;

wherein an upper surface of the respective cutter circumferential rims extends out over the respective pivotal supporting section to increase the width of the upper surface of the respective cutter circumferential rims.

The upper surface of the cutter circumferential rim is extended out over the pivotal supporting section to increase the width thereof in the radial direction to surround the outer cutter, thus making it possible to reduce the pressure of contact per unit area between the upper surface of the cutter circumferential rim and the outer cutter and the skin. This arrangement permits the protection of the skin. Furthermore, the pivotal supporting section can be disposed below the cutter circumferential rim rather than between the outer periphery of the cutter circumferential rim and the inner peripheral surface of the opening of a head bottom plate, thus allowing the sizes of the head bottom plate and the head unit to be reduced.

Further, the pivotal supporting section is covered by the cutter circumferential rim, thus minimizing the possibility of shaving debris adhering to the pivotal supporting section. This arrangement permits smooth pivotal movement of the cutter circumferential rim for a prolonged time. In addition, each cutter circumferential rim is detachable at the pivotal supporting section, permitting easy removal of the cutter circumferential rim from the main body for easy cleaning.

The width of the upper surface of the cutter circumferential rim in the radial direction may be increased evenly over the full circumference of the upper surface of the cutter circumferential rim. Alternatively, however, expanding only a part of the upper surface in the direction of a pivotal supporting section (in the direction along the pivotal axis) makes it possible to narrow the upper surface in a direction which is orthogonal to the pivotal axis and which passes the center of the outer cutter. The cutter circumferential rim does not vertically move at the pivotal supporting section, so that the pressure of contact on the skin may become larger; however, the contact area of the upper surface of the rim is large at the pivotal supporting section, allowing the contact pressure to be reduced. Furthermore, even when the width in the direction which passes the center of the outer cutter and which is orthogonal to the pivotal axis is decreased, the cutter circumferential rim itself significantly moves in the vertical direction (pivotal movement), making it possible to conveniently decrease the pressure of contact between the outer cutter and the skin. In general, the outer cutter is held such that it is vertically movable relative to the cutter circumferential rim, so that the contact pressure to skin can be further reduced by the vertical movement of the outer cutter itself in this case.

The pivotal supporting section may be constituted of a pair of pillars rising from the upper surface (a head bottom plate providing a head unit mounting surface) of a shaver main body, a pair of engaging recesses provided in the respective pillars, and a pair of projections which are provided on the cutter circumferential rim and which can be engaged with or disengaged from the engaging recesses. In this case, bending the outer periphery of the upper surface of the cutter circumferential rim to cover the outer sides of the pillars makes it possible to prevent the skin from touching the pillars or the pivotal supporting section thereby to securely protect the skin.

The pair of projections provided on the cutter circumferential rim may be formed as pivotable axial members which penetrate, from an inside diameter side, a pair of upright walls provided on a bottom surface of the cutter circumferential rim such that the upright walls house the outer cutter therein. In this case, the pivotal axial members are imparted with outward restoring tendency. Thus, the use of the pivotable axial members which are separate from the cutter circumferential rim permits improved movability of the projections and improved detachability of the cutter circumferential rim from the main body.

Here, to impart the outward restoring tendency to the pivotable axial members, both ends of an substantially semicircular wire spring, which is accommodated inside the cutter circumferential rim such that the wire spring surrounds the outer cutter, are locked on the pivotable axial members. In this case, the outward restoring force of the pivotable axial member can be set by adjusting the elastic force of the wire spring, thus enhancing design freedom.

A substantially arcuate guide wall for holding the outer cutter and a cutter retaining plate, which is detachably installed to the guide wall, may be provided on an inner bottom surface of the cutter circumferential rim, and the inner cutter may be accommodated between the outer cutter retained to the cutter circumferential rim and the cutter retaining plate. In this case, the inner cutter and the outer cutter can be easily separated for easy cleaning of the inner and outer cutters by detaching the cutter circumferential rims from the shaver main body and also detaching the cutter retaining plates from the cutter circumferential rims.

A plurality of cutter circumferential rims may be retained on the pivotal axis which is orthogonal to a straight line in a radial direction passing the center of the shaver main body and the center of the respective outer cutters and which passes the center of the respective outer cutters in a top plan view. There may be, for example, two, three or four cutter circumferential rims. In these cases, the cutter circumferential rims pivotally move in the vertical direction at an outer periphery side and at a central side of the shaver main body, leading to a comfortable touch when the upper surfaces of the outer cutters are pressed against the skin.

DESCRIPTION OF THE PREFERRED EMBODIMENTS

First Embodiment

Figure 1:
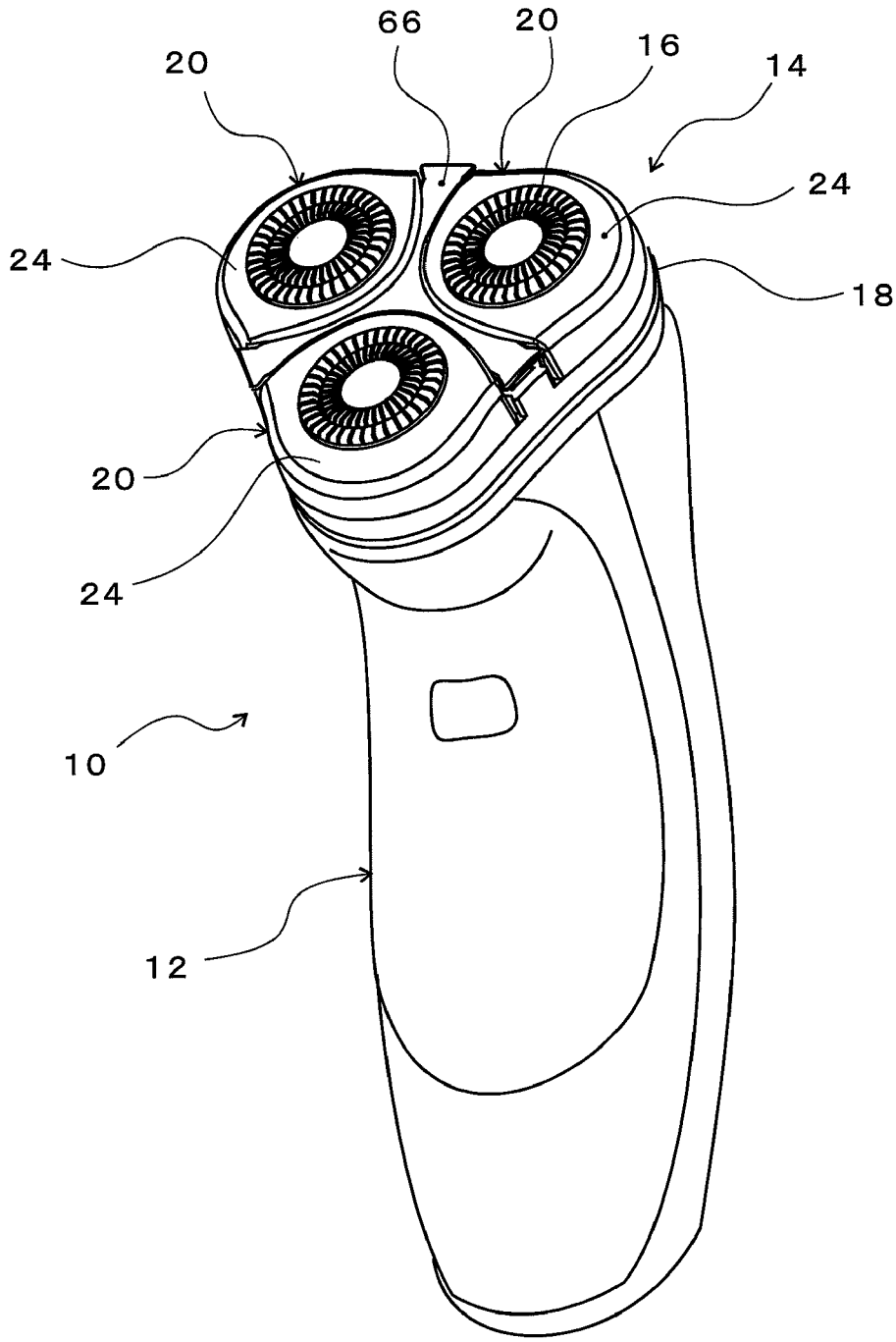
FIG. 1 is a perspective exterior view of a rotary electric shaver according to an embodiment of the present invention.

Referring to FIG. 1, a rotary electric shaver 10 combines a main body 12 and a head unit 14, which is mounted on the upper surface of the main body 12, into one piece. The main body 12 mainly accommodates an electric motor, a battery, and a control circuit (none of them being shown). The head unit 14 has three outer cutters 16 disposed on an equilateral-triangular apexes. Three cutter assemblies 20 are detachably retained on a head bottom plate 18, which provides the upper surface of the main body 12, such that the three cutter assemblies 20 are disposed equidistantly (at 120-degree intervals) relative to a center P of the head unit 14.

Figure 2A:
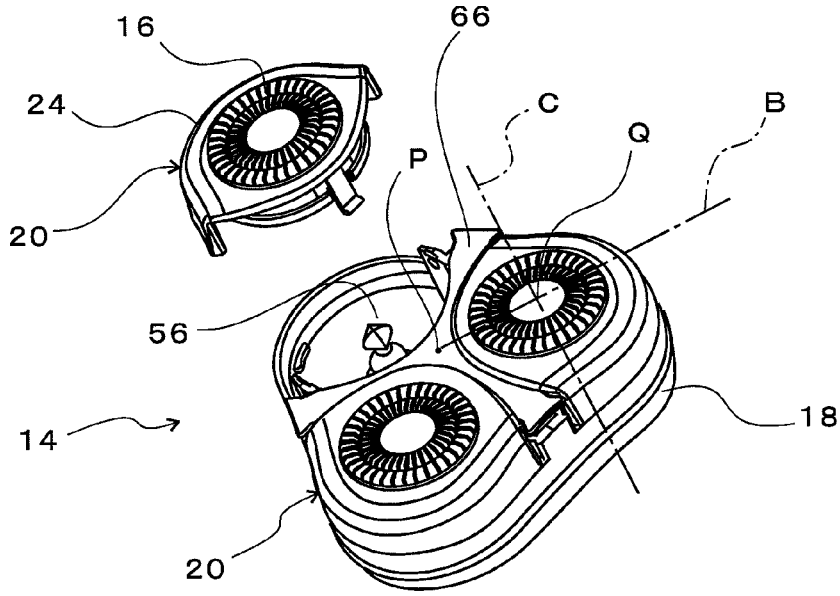
FIGS. 2A and 2B are exploded perspective views of a head unit of the rotary electric shaver in FIG. 1, FIG. 2A illustrating the head unit with one cutter assembly removed, and FIG. 2B illustrating the head unit with all cutter assemblies removed.
Figure 7A:
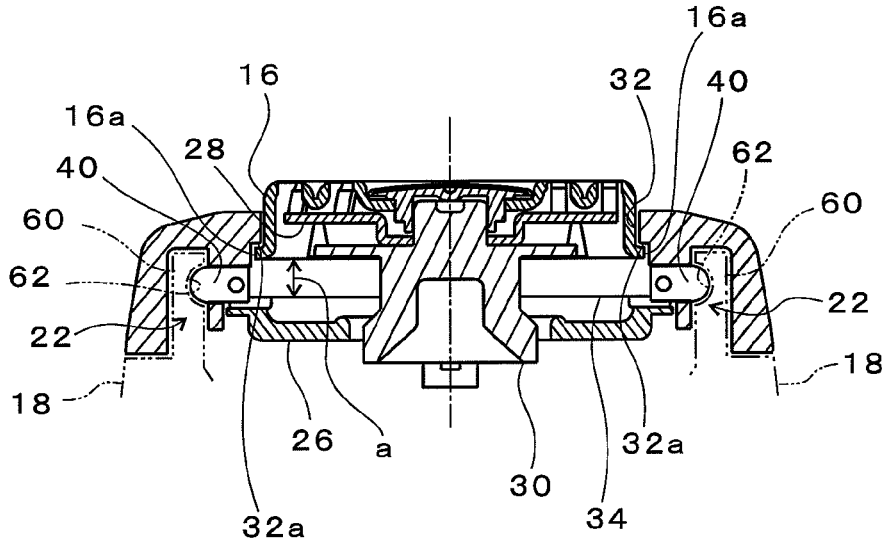
FIGS. 7A and 7B are sectional side views of the cutter assembly, FIG. 7A illustrating a section which includes a pivotal axis C, and FIG. 7B illustrating a section which is orthogonal thereto.

Each of the cutter assemblies 20 is pivotable about a straight line (pivotal axis) C which is orthogonal to a straight line B in a radial direction passing a center P (FIG. 2) of the head unit 14 and which passes a center Q of the outer cutter 16. In other words, each of the three cutter assemblies 20 is independently supported by pivotal supporting sections 22 (refer to FIG. 7A) and pivotally moves about its pivotal axis C.

Figure 3:
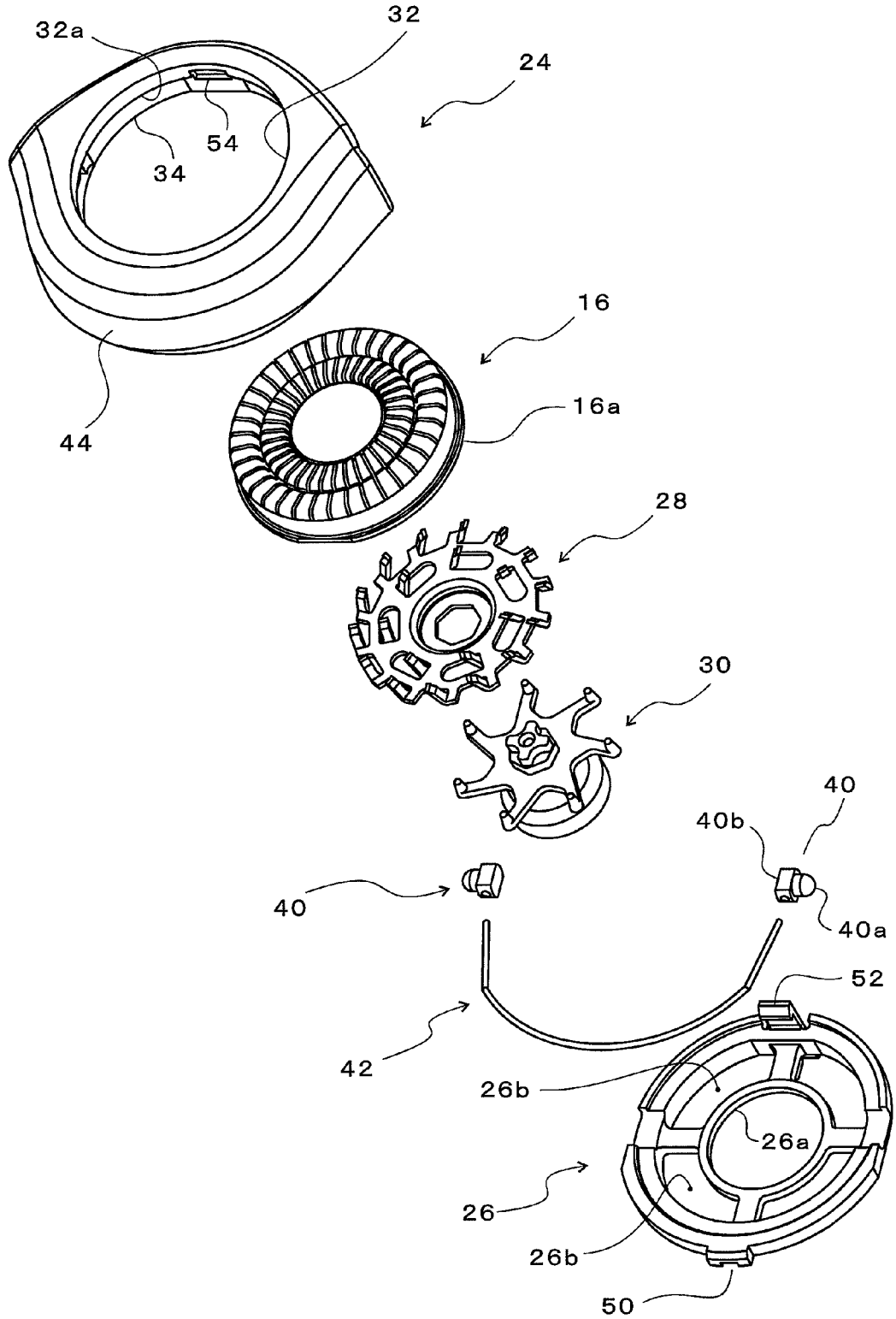
FIG. 3 is an exploded perspective view of one cutter assembly which has been disassembled and observed aslant from above.
Figure 4:
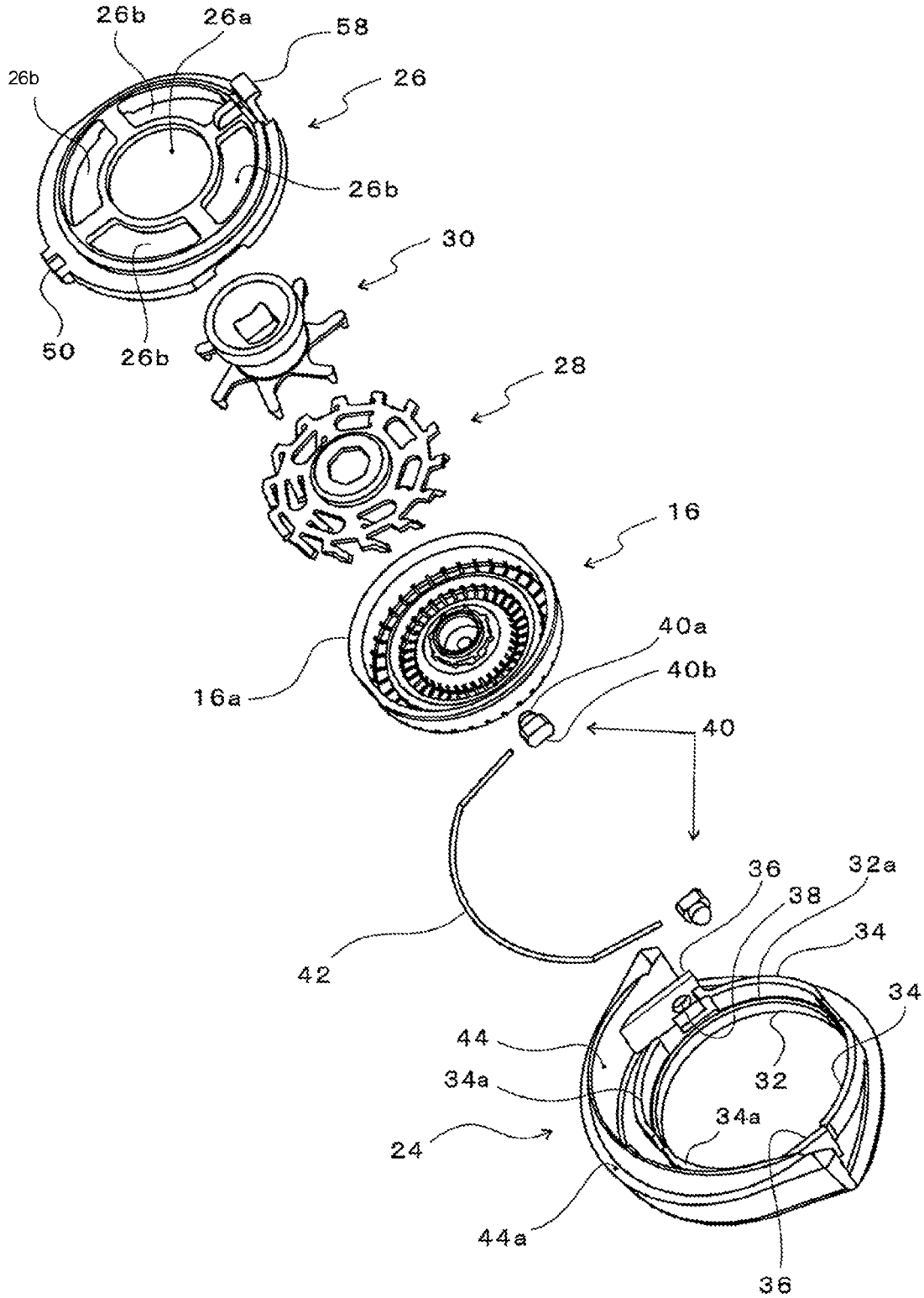
FIG. 4 is an exploded perspective view of one cutter assembly which has been disassembled and observed aslant from below.
Figure 5A:
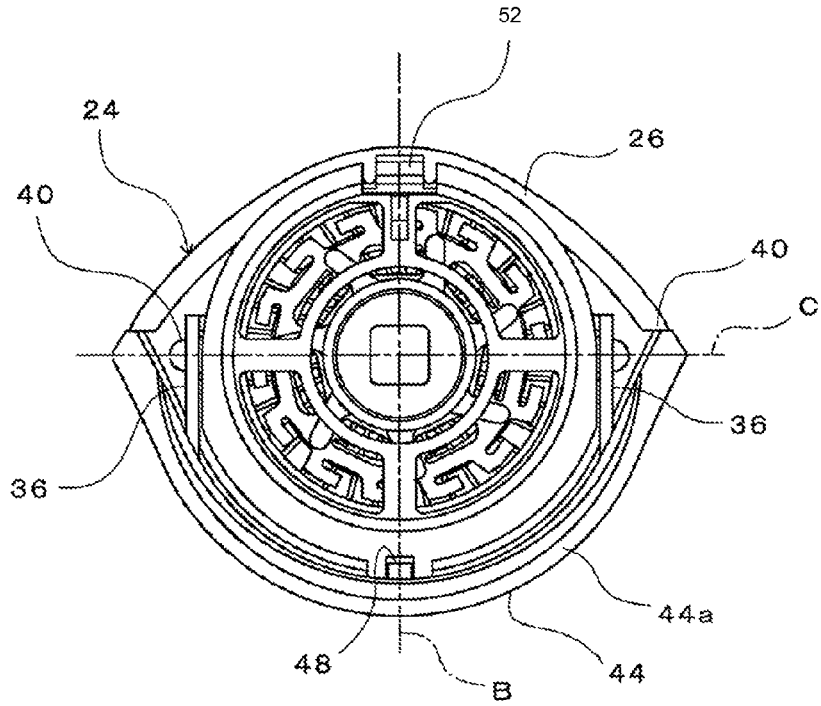
FIGS. 5A and 5B are bottom views of the cutter assembly, FIG. 5A illustrating an outer cutter, an inner cutter, and a cutter retaining plate, which have been assembled, and FIG. 5B illustrating the cutter assembly from which the outer cutter, the inner cutter, and the cutter retaining plate have been all removed.

As illustrated in FIGS. 3 and 4, the cutter assembly 20 comprises the outer cutter 16 shaped approximately like an inverted cup, an cutter circumferential rim (serving as a cutting member frame and also as a skin protection rim) 24 which holds the outer cutter 16, a cutter retaining plate 26 detachably secured to the cutter circumferential rim 24 from below, an inner cutter 28 accommodated between the outer cutter 16 and the cutter retaining plate 26, and an inner cutter shaft 30 made integral with the inner cutter 28. The cutter circumferential rim 24 has a circular opening 32 through which the outer cutter 16 passes from below. Four divided arcuate guide walls 34 and 34*a*, which have a slightly larger diameter than that of the opening 32 and are arranged in the circumferential direction, are protrusively provided on the inner lower surface of the cutter circumferential rim 24, as illustrated in FIGS. 4 and 5. A flange 16*a* (FIGS. 4 and 7A) provided on the opening rim of the outer cutter 16 engages a rim 32*a* of the opening 32 (FIG. 4) from below, thus restricting an upward escape of the outer cutter 16 from the cutter circumferential rim 24. The outer cutter 16 is vertically movable within a range of the heights of the guide walls 34, which guide the flange 16*a* (the range denoted by "a" in FIGS. 7A and 7B).

Figure 5B:
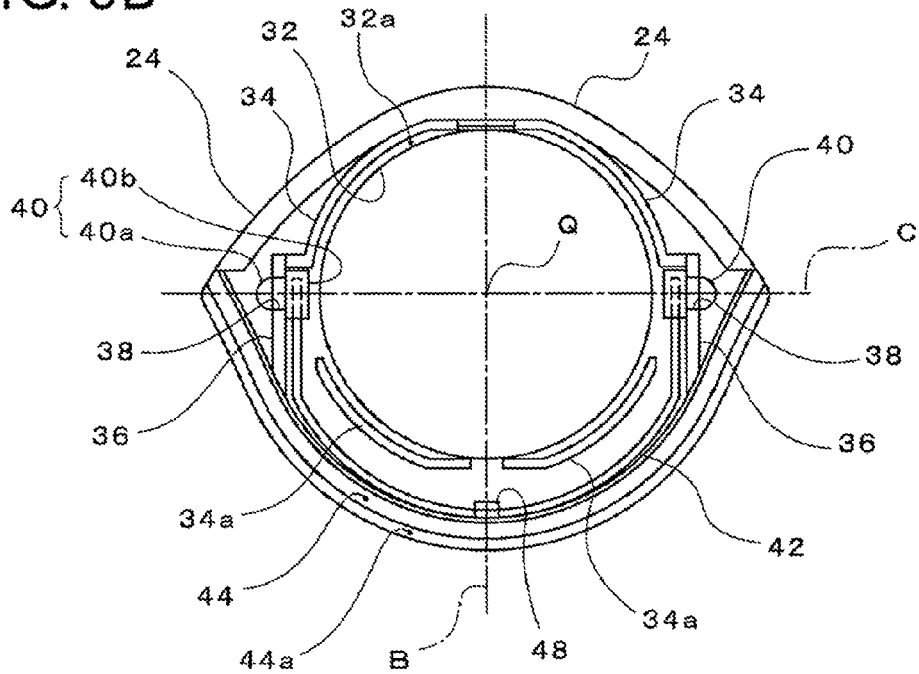
Figure 8A:
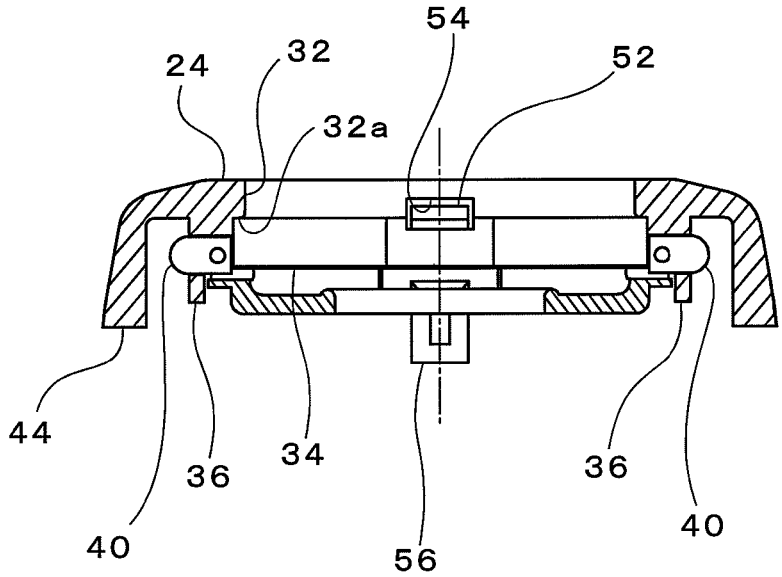
FIGS. 8A and 8B are sectional side views of the cutter assembly with the inner cutter removed therefrom, FIG. 8A illustrating a section which includes a pivotal axis C, and FIG. 8B illustrating a section which is orthogonal thereto.

The cutter assembly 20 will now be described with reference to FIGS. 5B and 8A. On the lower surface of the cutter circumferential rim 24, a pair of upright walls 36, 36 is formed at positions where opposing portions of the guide walls 34, 34, which oppose each other with the pivotal axis C therebetween, are expanded in the direction of the pivotal axis C. Each of these upright walls 36 has a small aperture 38 positioned on the pivotal axis C (FIGS. 5 and 8). Projections 40*a* of pivotable axial members 40 penetrate these apertures 38 from the inside of the opening 32. The projections 40*a* have semispherical distal ends, and only the distal portions jut out to the outside from the apertures 38 of the upright walls 36. Inside proximal portions 40*b* of the pivotable axial members 40 have a diameter which is larger than that of the apertures 38. The proximal portions 40*b* abut against the upright walls 36, thereby defining the protrusion amounts of the projections 40*a* in the outward direction. Both ends of a wire spring 42, which is substantially arcuate, are secured to the proximal portions 40*b* of the pair of right and left pivotable axial members 40, 40 on the inside diameter side, thereby imparting the outward restoring tendency.

The cutter circumferential rim 24 is provided with another pair of guide walls 34*a*, 34*a* on the opposite side from the guide walls 34, 34, sandwiching the pivotal axis C therebetween. A semicircular descent wall 44 is formed on the outer side of the guide walls 34*a*, 34*a* to surround the guide walls 34*a*, 34*a*. Both ends of the descent wall 44 extend out to cover the outer sides of the upright walls 36, 36 (refer to FIG. 4). The wire spring 42 is retained on the inner surface of the descent wall 44 by engaging a central portion thereof with a projecting first stopper 46 provided on the inner surface of the descent wall 44 (refer to FIG. 7B and FIG. 8B). Thus, both ends of the wire spring 42 are secured by being fitted in the proximal portions 40*b* of the pivotable axial members 40. The wire spring 42 imparts a restoring force which pushes the projections 40*a*, 40*a* of the pivotable axial members 40, 40 outward.

As illustrated in FIGS. 3 and 4, the inner cutter 28 and the inner cutter shaft 30 are set in the outer cutter 16 from below the cutter circumferential rim 24 and then the cutter retaining plate 26 is attached to the cutter circumferential rim 24. The cutter retaining plate 26 has an inner opening 26*a* at the center thereof through which a lower portion of the inner cutter shaft 30 passes, and outer openings 26*b* which surround the inner opening 26*a* and which let beard trimmings or shaving debris fall therethrough. The outer periphery of the cutter retaining plate 26 is provided with a lug 50, which engages a projecting second stopper 48 formed in the descent wall 44 of the cutter circumferential rim 24, and an attaching/detaching hook 52 positioned on the opposite side from the lug 50.

Figure 7B:
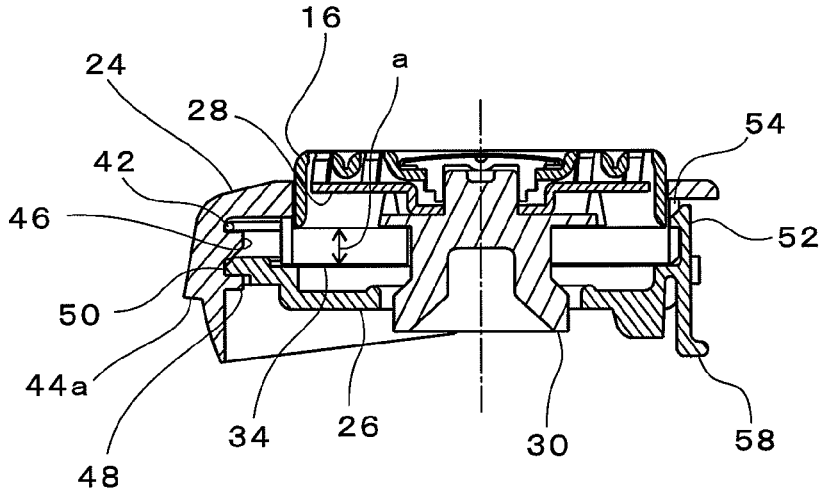
Figure 8B:
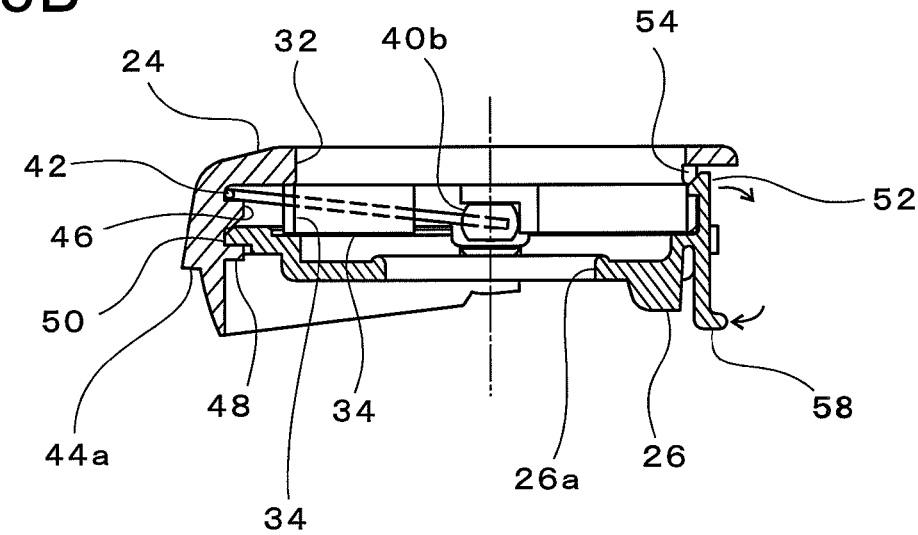

As illustrated in FIGS. 7B and 8B, the cutter retaining plate 26 is fixed by first engaging the lug 50 with the second stopper 48 and then engaging the upper end of the hook 52 with an engaging aperture 54 provided in the guide wall 34 in a state the upper surface in the vicinity of the outer periphery of the cutter retaining plate 26 is abutted against an end surface of the guide wall 34 of the cutter circumferential rim 24 from below. The hook 52 has an operating end 58 formed as an integral portion thereof. By pushing the operating end 58 into the inside, the upper end of the hook 52 is disengaged from the engaging aperture 54, thus allowing the cutter retaining plate 26 to be released from the cutter circumferential rim 24.

The cutter assembly 20 constructed as described above is detachably mounted on the head bottom plate 18 of the main body 10 by the pivotal supporting sections 22. More specifically, three inner cutter drive shafts 56 projected from the head bottom plate 18, and a pair of pillars 60 is installed in a protruding manner on the pivotal axis C of each of the three cutter assemblies 20, each of the inner cutter drive shafts 56 being held therebetween (refer to FIG. 2(B)). Each of the pillars 60 has an engaging recess 62 with or from which the pivotable axial member 40 of the cutter assembly 20 engages or disengages. The engaging recess 62 may alternatively be a through hole and may have any shape as long as the shape allows the projection 40*a* at the distal end of the pivotable axial member 40 to engage therewith or disengage therefrom.

Figure 2B:
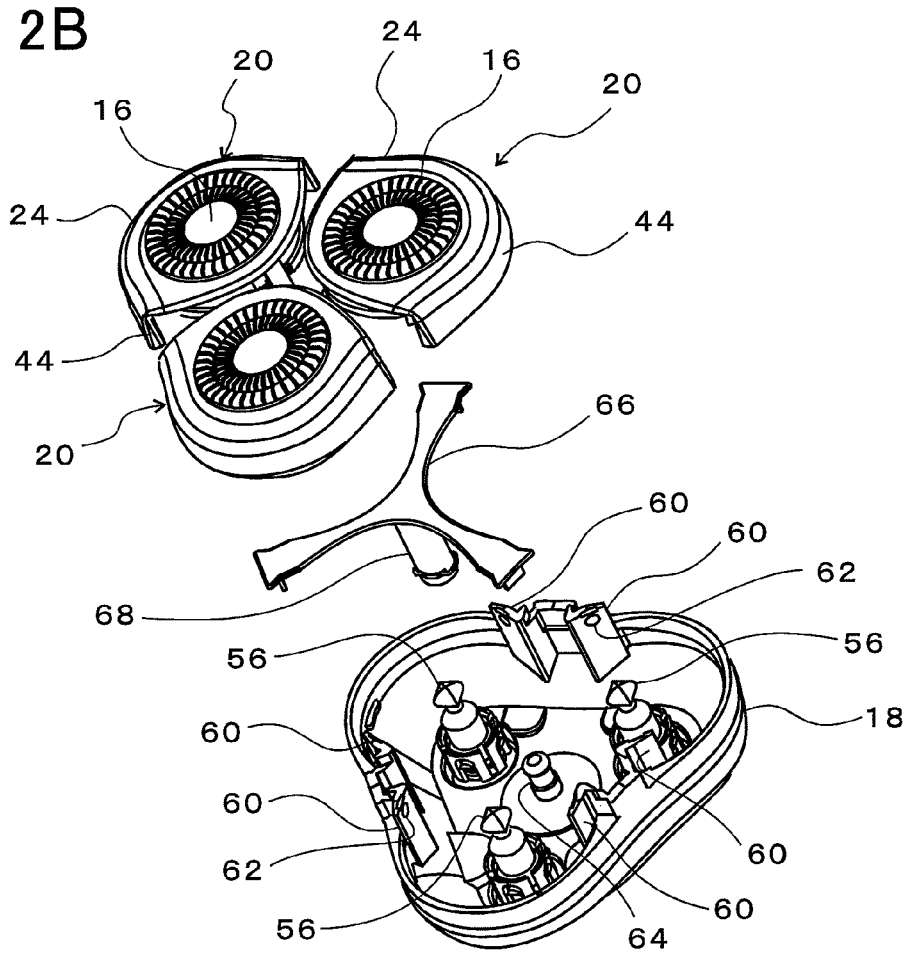

A cover mounting shaft 64 projects out at the center of the head bottom plate 18 of the main body 10, and a trifurcate cover 66 is detachably installed onto the cover mounting shaft 64 (FIG. 2B). More specifically, a cylindrical pillar 68, which is to be snapped onto the cover mounting shaft 64, projects at the center of the bottom surface of the cover 66. Pushing the pillar 68 down to fit it onto the outer periphery of the cover mounting shaft 64 by snapping or clicking secures the trifurcate cover 66 in place. The pillar 68 includes a built-in coil spring (not shown), which imparts an upward restoring tendency to the cover 66 when the cover 66 is secured onto the cover mounting shaft 64. Each extended arm end of the cover 66 in the direction of the outer periphery is locked between the adjacent pillars 60, 60 of the head bottom plate 18.

After attaching the cover 66 to the head bottom plate 18, the cutter assembly 20 is detachably installed onto the pillars 60 with a click. More specifically, the lower end of the inner cutter shaft 30 is aligned with the inner cutter drive shaft 56 while setting the descent wall 44 of the cutter circumferential rim 24 of the cutter assembly 20 along the outer periphery of the head bottom plate 18. An upward restoring tendency is imparted to the polygonal (rectangular) engaging head of the inner cutter drive shaft 56 by a coil spring (not shown) built in the inner cutter drive shaft 56. The lower end of the inner cutter shaft 30 has an engaging recess in which the engaging head of the drive shaft 56 is locked. With such arrangement, by pushing the cutter assembly 20 downward, the inner cutter 28 comes in an upward resilient contact with the outer cutter 16 by the restoring force of the inner cutter drive shaft 56.

When the cutter assembly 20 is further pushed downward against the restoring force, the distal projection 40*a* of the pivotable axial member 40 attached to the cutter circumferential rim 24 comes in contact with the upper edge of the pillar 60 of the head bottom plate 18 and is pushed in against the wire spring 42 until the projection 40*a* engages with the engaging recess 62 of the pillar 60 with a snap or a click. In this state, the cutter assembly 20 pivotally moves about the pivotable axial member 40, i.e., the pivotal axis C.

Figure 6A:
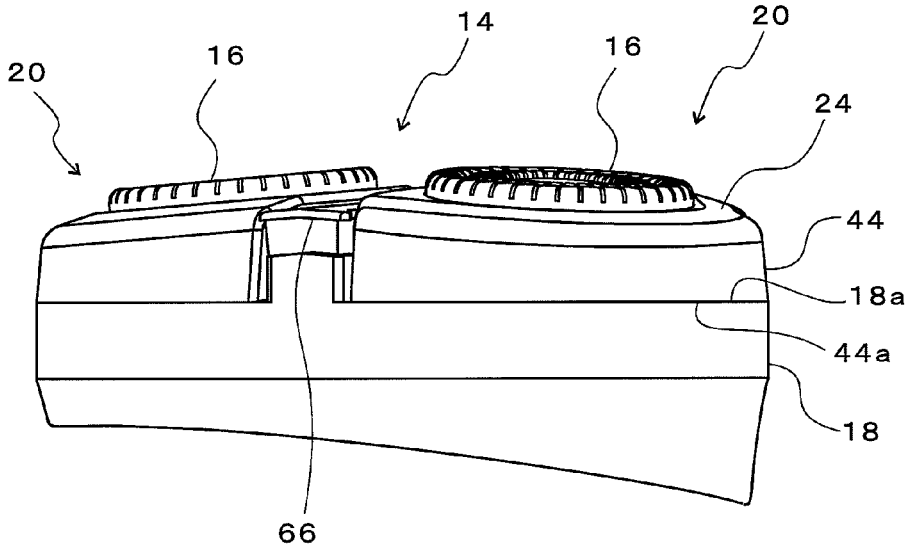
FIGS. 6A and 6B are side views of the head unit, FIG. 6A illustrating the head unit in a stationary state (a normal standby mode), and FIG. 6B illustrating the head unit, which has been tilted inward when the vicinity of the center of the head unit has been pushed down (an in-use mode)
Figure 6B:
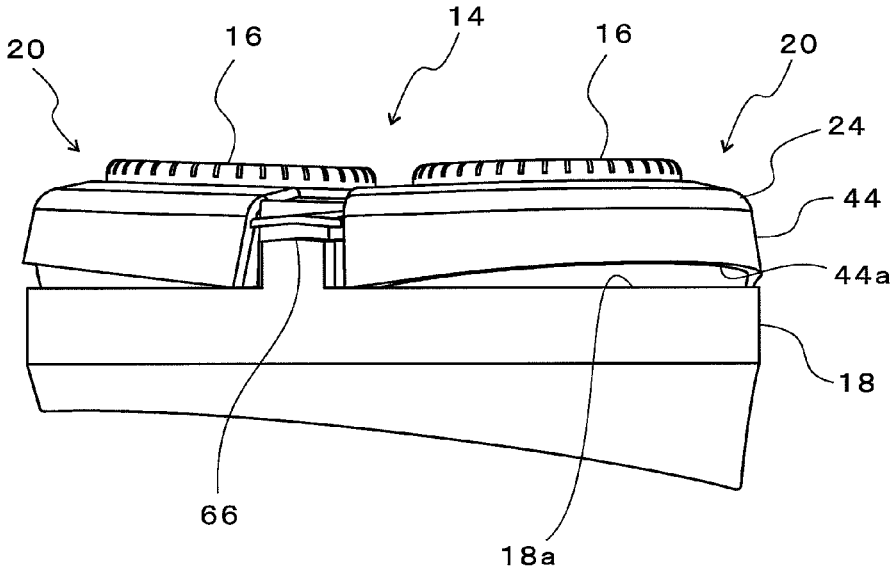

The restoring force of the coil spring built in the inner cutter drive shaft 56 is applied to the outer cutter 16 and the cutter circumferential rim 24 upward through the intermediary of the inner cutter 28. Thus, the cutter assembly 20 becomes still and stable in the state illustrated in FIG. 6A. At this time, a stepped portion 44*a* provided on the outer periphery of the descent wall 44 of the cutter circumferential rim 24 (refer to FIGS. 6A, 6B, 7B, and 8B) abuts against a peripheral upper edge 18*a* of the head bottom plate 18 to position the cutter assembly 20.

With the three cutter assemblies 20 installed, pressing the central area of the head unit 14 against the skin to be shaved causes the cutter assemblies 20 to go down at the center of the head unit 14. In other words, the central portion of the head unit 14 goes down about the pivotal axis C (the state illustrated in FIG. 6B). The upper surface of the cutter circumferential rim 24 is long (wide) in the direction of the pivotal axis C and short (narrow) in the direction orthogonal thereto. The cutter circumferential rim 24 pivotally and vertically moves in the direction orthogonal to the pivotal axis C, so that the pivotal movement of the cutter circumferential rim 24 and the descent of the outer cutter 16 prevent the contact pressure applied by the upper surface of the cutter circumferential rim 24 and the outer cutter 16 to the skin from becoming excessive. This secures protection of the skin.

On the other hand, the cutter circumferential rim 24 does not pivotally move in the direction orthogonal to the pivotal axis C, so that the contact pressure on the skin on the pivotal axis will be absorbed only by the vertical movement of the outer cutter 16 relative to the cutter circumferential rim 24, leading to a possibility of inadequate absorption of the contact pressure. However, the upper surface of the cutter circumferential rim 24 expands out over the pivotal supporting sections 22, that is, expands in the direction of the pivotal axis C; therefore, the area of contact with the skin in the direction of the pivotal axis C is increased. This leads to a lower pressure of contact (the contact pressure per unit area) between the skin and the outer cutters, thus enhancing the protective effect for skin.

The pivotal supporting sections 22 supporting the cutter circumferential rim 24 is not located between the cutter circumferential rim 24 and the head bottom plate 18, which provides the outer cutter frame. Rather, the pivotal supporting section 22 is located under the cutter circumferential rim. This arrangement makes it possible to reduce the size of the head bottom plate 18 and minimize the chances of shaving debris adhering to the pivotal supporting sections 22. Furthermore, each of the cutter assemblies 20 is detachably installed to the main body 10, permitting easy cleaning of the head unit 14.

The invention claimed is:

1. A rotary electric shaver which is provided with a shaver main body and a head bottom plate disposed at a top of the shaver main body, the head bottom plate is coupled to a plurality of cutter assemblies dispose thereon, each of the plurality of cutter assemblies pivotally hold a respective one of a plurality of outer cutters and a plurality of inner cutters disposed therein, a plurality of inner cutter drive shafts projected from the head bottom plate are configured to engage a respective one of the plurality of inner cutters and rotatively drive the plurality of inner cutters while bringing the plurality of inner cutters into resilient contact with inner surfaces of the plurality of outer cutters, the rotary electric shaver comprising:

a plurality of cutter circumferential rims, wherein each of the plurality of cutter circumferential rims has an opening and is separately provided for each of the plurality of outer cutters and surrounds an outer periphery of a respective one of the plurality of the outer cutters to support the respective one of the plurality of the outer cutters in the opening; and a plurality of pivotal supporting sections which each of the plurality of pivotal supporting sections pivotally and detachably retains a respective one of the plurality of cutter circumferential rims on a pivotal axis which passes a center of the respective one of the plurality of outer cutters;

wherein an upper surface of the respective one of the plurality of cutter circumferential rims extends from a protruding portion of the respective one of the plurality of outer cutters in a direction of the pivotal axis out over a respective one of the plurality of pivotal supporting sections to define a width of the upper surface of the respective one of the plurality of cutter circumferential rims.

2. The rotary electric shaver according to claim 1, wherein the width of the upper surface of the respective one of the plurality of cutter circumferential rims is larger in the direction of the pivotal axis than in a direction which is orthogonal to the direction of the pivotal axis and passes the center of the respective one of the plurality of outer cutters.

3. The rotary electric shaver according to claim 1, wherein each of the plurality of pivotal supporting sections comprises:

a pair of pillars which extend from the head bottom plate, a pair of engaging recesses each provided on a respective one of the pair of pillars, and a pair of projections which are provided on the respective one of the plurality of cutter circumferential rims and which are configured to be engaged with or disengaged from a respective one of the pair of engaging recesses.

4. The rotary electric shaver according to claim 3, wherein a pair of upright walls are provided on a bottom surface of the respective one of the plurality of cutter circumferential rims such that the pair of upright walls house the respective one of the plurality of outer cutters therein, and each of the pair of projections provided on the respective one of the plurality of cutter circumferential rims is formed as a pivotable axial member which penetrates a respective one of the pair of upright walls from an inside thereof and which is imparted with an outward restoring tendency.

5. The rotary electric shaver according to claim 4, wherein the respective one of the pair of upright walls abut an inner side of the respective one of the pair of pillars.

6. The rotary electric shaver according to claim 1, wherein an outer peripheral edge of the respective one of the plurality of cutter circumferential rims descends from over a top of the respective one of the plurality of pivotal supporting sections to surround an outer side of the respective one of the plurality of pivotal supporting sections.

7. The rotary electric shaver according to claim 1, wherein each of the plurality of cutter circumferential rims comprises an approximately arcuate guide wall which supports the respective one of the plurality of outer cutters on an inner bottom surface thereof, and a cutter retaining plate detachably installed to the guide wall, and the respective one of the plurality of inner cutters is accommodated between the respective one of the plurality of outer cutters held in the respective one of the plurality of cutter circumferential rims and the cutter retaining plate.

8. The rotary electric shaver according to claim 1, wherein each of the plurality of cutter circumferential rims is retained on the pivotal axis which is orthogonal to a straight line, which extends in a radial direction passing through a center of the shaver main body and the center of the respective one of the plurality of outer cutters and the pivotal axis passes through a center of the respective one of the plurality of outer cutters in a top plan view.

9. The rotary electric shaver according to claim 1, wherein the upper surface of the respective one of the plurality of cutter circumferential rims extends from an inner side of the respective one of the plurality of pivotal supporting sections in the direction of the pivotal axis out over past an outer side of the respective one of the plurality of pivotal supporting sections to define the width of the upper surface of the respective one of the plurality of cutter circumferential rims.

* * * * *